United States Patent [19]

Yearwood

[11] Patent Number: 5,042,780

[45] Date of Patent: Aug. 27, 1991

[54] FENCE POST BRACE

[76] Inventor: M. Deon Yearwood, Rte. 2, Box 23, Hydro, Okla. 73048

[21] Appl. No.: 597,256

[22] Filed: Oct. 15, 1990

[51] Int. Cl.[5] ..... B21F 27/00

[52] U.S. Cl. ..... 256/36; 256/35; 52/150

[58] Field of Search ..... 256/35, 36; 52/150, 52/146

[56] References Cited

U.S. PATENT DOCUMENTS

| | | | |
|---|---|---|---|
| 708,087 | 9/1902 | Smith | 256/35 |
| 1,725,475 | 8/1929 | Peterson | 189/314 |
| 1,951,282 | 3/1934 | Hise et al. | 256/35 X |
| 2,147,496 | 2/1939 | Nelson | 52/150 |

FOREIGN PATENT DOCUMENTS

| | | | |
|---|---|---|---|
| 11206 | 3/1934 | Australia | 256/35 |

*Primary Examiner*—Andrew V. Kundrat
*Attorney, Agent, or Firm*—Robert K. Rhea

[57] ABSTRACT

A wire fence T-post brace is formed by a length of rigid metallic material having a transverse soil engaging member adjacent one of its earth penetrating ends. The other end of the brace is pivotally connected with an open angularly shaped brace removably frictionally gripping opposing sides of a T-post when the brace is engaged with the T-post and driven into the soil during the last earth penetrating movement of the T-post which prevents movement of the T-post in the direction of its brace by wire connected with the T-post and tensioned in the direction of the brace.

6 Claims, 1 Drawing Sheet

FENCE POST BRACE

BACKGROUND OF THE INVENTION

1. Field of the Invention

This invention relates to wire fences and more particularly to braces for metallic T-posts used in temporary or electric fences.

T-post are frequently used for temporary or electric fences for the reason they are easily driven into the soil and removed therefrom.

However, it is necessary that corner posts and some line posts be braced against the tension of the wire, strung thereon or around the post to prevent collapse of the fence when the wire is tensioned as by an animal attempting to cross the boundary line.

2. Description of the Prior Art

The most pertinent patent is believe to be U.S. Pat. No. 1,725,475. This patent discloses a pair of clamps surrounding respective end portions of an angularly disposed brace interposed between an upright post and an anchor post and in cooperation with a pair of cams, interposed between the brace or post and the respective clamp, which binds the brace to the post or anchor post for preventing movement of one relative to the other.

This invention provides a fence post brace in which a transverse cross member at one end of the brace engages the surface of the earth when that end portion of the brace is forced into the soil with its other end connected by a bracket to the post to be braced and the bracket inclined relative to the vertical axis of the post to prevent movement of either with respect to the other.

SUMMARY OF THE INVENTION

An elongated metallic member is provided with a transverse bar adjacent one end portion. The other end portion of the metallic member is pivotally connected with one end portion of an angular bracket which transversely surrounds, in gripping relation, opposite sides of a T-post, with a portion of the bracket lodged against one of a series of protrusions stuck out of the face surface of the T-post.

The brace and bracket are placed in operative position relative to a post prior to driving the post to its final soil penetrating depth, so that the brace ground engaging end portion is simultaneously inserted into the earth, wherein the transverse bar forms a stop bearing against the surface of the earth to provide the gripping action of the angle bracket relative to the post.

The principal object of this invention is to provide a rigid brace structure for fence line posts or corner posts utilizing T-posts for maintaining wire in a selected taut position.

DESCRIPTION OF THE PREFERRED EMBODIMENTS

Figure 2:
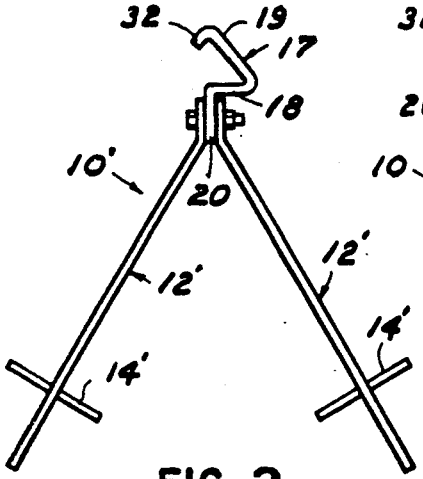
FIG. 2 is an elevational view of a corner post brace.
Figure 1:
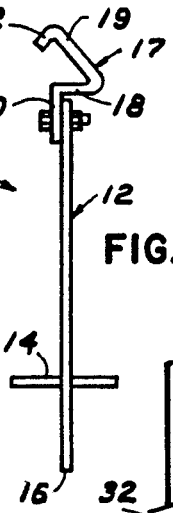
FIG. 1 is an elevational view of a line post brace.
Figure 3:
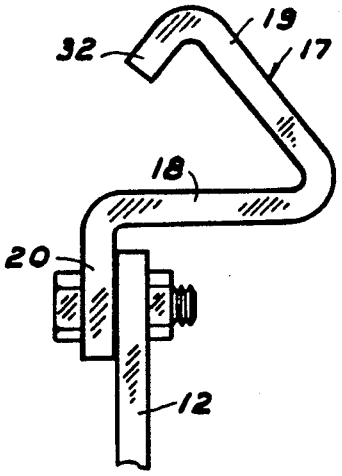
FIG. 3 is a fragmentary elevational view, to a larger scale, of a fence post gripping bracket.

Like characters of reference designate like parts in those figures of the drawings in which they occur.

In the Drawings

The reference numeral 10 indicates a fence post brace formed by a length of angle iron, a portion of a conventional T-post or a length of strap iron 12.

The brace 12 is provided with a transverse member 14 adjacent its ground engaging tip 16.

The other or top end of the brace is provided with a substantially V-shaped strap iron angular bracket 17, characterized by diverging legs 18 and 19 and a projection 20 on the end of the leg 18 in the plane of the V-shape and normal to the leg 18. The projection 20 is pivotally connected flatly with one end portion of the brace 12. The leg 18 of the V-shape transversely engages the lower edge surface of one of the lugs or stuck out portions 26 on the bar of a T-shape, in transverse section, post 30.

The other leg 19 of the bracket V-shape extends transversely of the stem of the T-shape post 30 and terminates in a lip 32 in the plane of the V-shape to form a hook transversely gripping the T-post stem.

Figure 4:
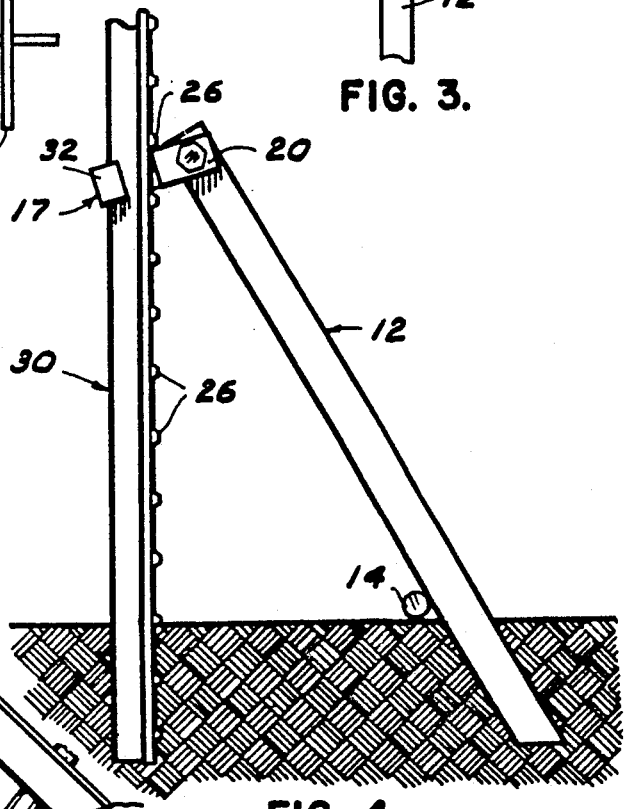
FIG. 4 is a fragmentary side elevational view, partially in section, of the fence line post brace of FIG. 1 in operative position; and, FIG. 5 is a fragmentary perspective view of the corner post brace of FIG. 2 in operative position.
Figure 5:
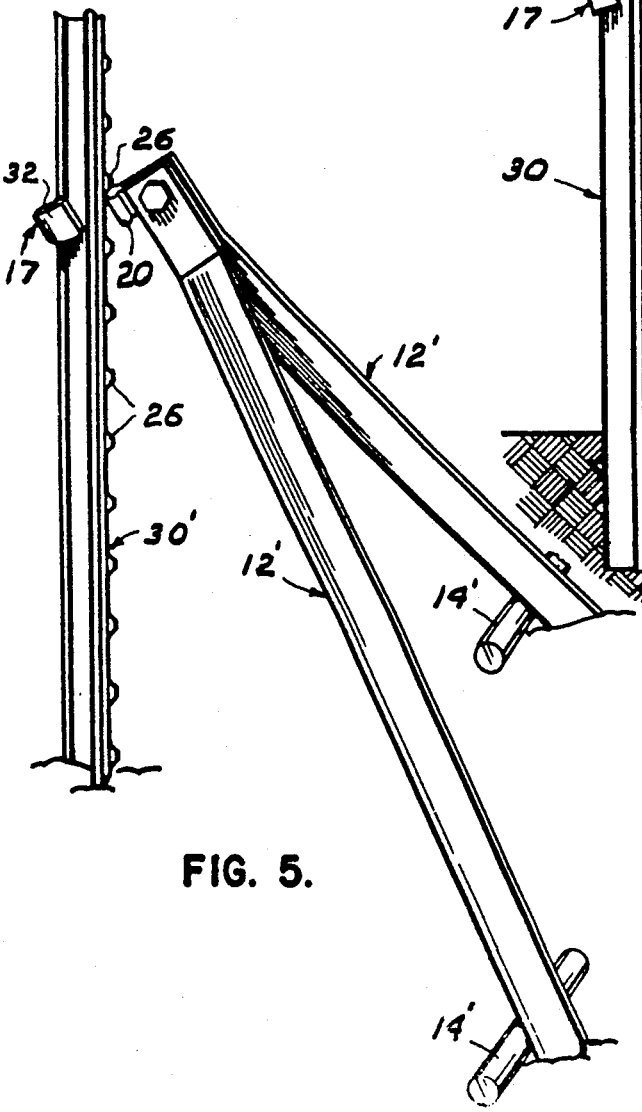

The pivoting feature of the bracket 17 relative to the brace 12 permits a binding action of the bracket 17 on the T-post 30 in response to a force on the post intending to move the bracket longitudinally of the T-post in an upward direction, as viewed in FIGS. 4 and 5.

The reference numeral 10' indicates a brace for a corner post comprising a pair of braces 12' pivotally joined at their top end portions as viewed in the drawings, on opposing sides of the post engaging bracket projection 20 and diverging downwardly therefrom. Each brace 12' of the pair of braces is similarly provided with a stop bar 14'.

OPERATION

In operation, the post 30 is installed in line with other posts in the fence being built.

The brace 10 is disposed in the direction that the post 30 is to be braced against movement and secured thereto as explained hereinabove to prevent movement of the post 30 to the right, as viewed in FIG. 4.

The corner brace 10' is similarly connected by its bracket 17' with a corner post 30' as illustrated by FIG. 5.

The post braces are installed by first driving the post 30 or 30' into the soil until it is approximately five or six inches from its final soil penetration depth.

The respective brace 10 or 10' is then positioned in a preferred alignment with the wire, not shown, to be strung from the post and the bracket 17 engaged with the T-post.

The post is finish driven into the earth to the limit of its desired earth penetrating depth. This action simultaneously drives the ground engaging end portion 16 of the post brace or braces into the soil so that the cross members 14, 14' are firmly engaged with the soil surface which prevents movement of the post 30 or 30' in the direction of the respective brace.

Obviously the invention is susceptible to changes or alterations without defeating its practicability. Therefore, I do not wish to be confined to the preferred embodiment shown in the drawings and described herein.

I claim:

1. In a wire fence structure having an upright elongated metallic fence post T-shaped in transverse section having its depending end portion driven into the surface of the earth and having a stem portion normal to the bar of the T-shape and having a coextensive series of longitudinally spaced-apart protrusions struck out from the surface of the bar opposite the stem, the improvement comprising:

an inclined elongated brace having one end disposed adjacent the bar of the post T-shape and having its other end portion inserted into the surface of the earth;

V-shaped bracket means gripping said post and pivotally connected with the upper end portion of said brace for preventing upward movement of said brace relative to said post; and, earth surface engaging stop means transversely connected with the depending end portion of said brace for preventing movement of said post, in the direction of said brace and additional earth penetrating movement of said brace, by a force against the post opposite the position of said brace.

2. The combination according to claim 1 in which said bracket means is characterized by a pair of legs defining the V-shape and further including:

a projection on the end of one of the legs extending laterally in the plane of the V-shape and connected with said brace; and, a lip on the end of the other said leg and projecting toward said one leg for forming a hook gripping an intermediate portion of the stem of said T-shaped post.

3. The combination according to claim 2 in which said protrusion and said lip are respectively disposed normal to the respective leg of the V-shape.

4. In a wire fence structure having an upright elongated metallic fence post T-shaped in transverse section having its depending end portion driven into the surface of the earth and having a stem portion normal to the bar of the T-shape and having a coextensive series of longitudinally spaced-apart protrusions struck out from the surface of the bar opposite the stem, the improvement comprising:

a pair of elongated inclined braces having one end of each brace of said pair of braces juxtaposed adjacent the bar of the post T-shape and having their respective other end portions disposed in diverging relation and inserted into the surface of the earth;

V-shaped bracket means gripping said post and pivotally connected between said pair of braces juxtaposed ends for preventing upward movement of said braces relative to said post; and, earth surface engaging stop means transversely connected with the depending end portion of each brace of said pair of braces for preventing movement of said post, in the direction of either brace of said pair of braces and additional earth penetrating movement of either brace of said pair of braces, by a force against the post opposite the position of either brace of said pair of braces.

5. The combination according to claim 4 in which said bracket means is characterized by a pair of legs defining the V-shape and further including:

a projection on the end of one of the legs extending laterally in the plane of the V-shape and connected between said pair of braces; and, a lip on the end of the other said leg and projecting toward said one leg for forming a hook gripping an intermediate portion of the stem of said T-shaped post.

6. The combination according to claim 5 in which said protrusion and said lip are respectively disposed normal to the respective leg of the V-shape.

* * * * *